US006577922B2

(12) United States Patent
Gadrix et al.

(10) Patent No.: US 6,577,922 B2
(45) Date of Patent: Jun. 10, 2003

(54) POINT OF SALE PRODUCT PERSONALIZATION SYSTEM

(75) Inventors: M. Allison Gadrix, Atlanta, GA (US); John P. Giles, Atlanta, GA (US); Katherine S. Stone, Peachtree City, GA (US); James Michael Watson, Fairburn, GA (US); Masayuki Inoue, Tokyo (JP)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 09/918,366

(22) Filed: Jul. 30, 2001

(65) Prior Publication Data

US 2003/0023344 A1 Jan. 30, 2003

(51) Int. Cl.[7] ..... G06F 17/00
(52) U.S. Cl. ..... 700/233; 700/235
(58) Field of Search ..... 700/231, 232, 700/233, 234, 235; 53/557, 585, 442

(56) References Cited

U.S. PATENT DOCUMENTS

| | | | | |
|---|---|---|---|---|
| 3,200,561 | A | 8/1965 | Siegel et al. | 53/184 |
| 3,523,052 | A | 8/1970 | Bolen | 156/521 |
| 3,640,049 | A | 2/1972 | Fritz et al. | 53/30 |
| 3,777,446 | A | 12/1973 | Graver | 53/30 |
| 3,866,331 | A | 2/1975 | Evans, Jr. | 34/216 |
| 4,016,706 | A | 4/1977 | Braker et al. | 53/14 |
| 4,072,553 | A | 2/1978 | Braker et al. | 156/423 |
| 4,092,382 | A | 5/1978 | Heckman et al. | 264/25 |
| 4,243,466 | A | 1/1981 | Lindee | 156/363 |
| 4,446,616 | A | 5/1984 | Waterman | 29/775 |
| 5,111,528 | A | 5/1992 | Hannen et al. | 392/379 |
| 5,390,477 | A | 2/1995 | Sowden | 53/557 |
| 5,475,969 | A | 12/1995 | Sowden | 53/557 |
| 5,483,783 | A | 1/1996 | Lerner et al. | 53/399 |
| 6,098,381 | A | 8/2000 | Schmetzer | 53/557 |

OTHER PUBLICATIONS

Print out pages (12 Sheets) from the Pepsi Co. website at www.Pepsi.com dated Aug. 1, 2001.

Phase Fire Systems, Inc. article entitled "Shrink Tunnel Ovens, G1 Recirculating Shrink Tunnel Oven" dated Oct. 27, 2000, (2 pages) from website www.phasefiresystems.com.

Phase Fire Systems, Inc. article entitled "Banders and Sleevers, SBA Shrink Film Banders and Sleevers" dated Oct. 27, 2000, (2 pages) from website www.phasefiresystems.com.

Fuji Astec, Inc. pamphlet entitled "LA/CBA–8100, 9800 Series, Shrink Sleeve Applicator for Small Container" and "CBA–6000 Series, High Speed Tamper Evident Seal Applicator" dated Oct. 27, 2000 from website www.fujiseal.com.

Fuji Seal Europe pamphlet entitled "Internationally renowned application machinery" dated Oct. 27, 2000 from website www.fujiseal.com.

*Primary Examiner*—Khoi H. Tran
(74) *Attorney, Agent, or Firm*—Sutherland Asbill & Brennan LLP

(57) ABSTRACT

A method for personalizing a product at the point of sale by a consumer. The method may include the steps of selecting a product, purchasing the product, selecting a shrink-wrap sleeve to be applied to the product, placing the sleeve on the product, and affixing the sleeve on the product.

28 Claims, 6 Drawing Sheets

POINT OF SALE PRODUCT PERSONALIZATION SYSTEM

TECHNICAL FIELD

The present application relates generally to personalizing a product at the point of sale and more particularly relates to selecting and applying a personalized expression to a product at the point of sale.

BACKGROUND OF THE INVENTION

Product manufacturers and/or distributors often package a given product in any number of different formats or appearances. The same product may come in different size packaging, different types of packaging, and/or with different types of packaging graphics or designs. For example, a beverage may come in containers such bottles, cans, boxes, pouches, and the like; the container may come in different sizes, shapes, or configurations; and the container may come with packaging graphics that may vary with different promotional campaigns, or even vary with the seasons, geography, current events, or otherwise.

The variations in packaging, however, generally are determined by the manufacturer and/or the distributor of the product. Further, these variations generally are determined prior to the point of sale. The individual consumer may never have any input in the appearance of the packaging. Rather, the consumer is generally left to choose from whatever packaging may be available at a given retail location.

Consumers, however, have often sought new and unique ways to express their individuality and personal preferences. For example, consumers have long worn T-shirts or other items with any number of different messages, designs, or other types of self-expression thereon. Likewise, consumers have long worn articles emblazoned with the logos of their favorite sporting teams, musical group, cities, or even consumer products. Once again, however, although a consumer may be able to purchase an article or a product with an expression of some sort thereon, the consumer rarely has an opportunity to personalize that product or connect the given product with a selected expression.

What is needed, therefore, is a means by which a consumer can personalize product packaging with an expression that suits his or her own personal preferences. The personalization means should be easy to use and available to the consumer at or near the point of sale. The personalization means, however, should be relatively inexpensive and not interfere with the consumer's enjoyment or use of the product.

SUMMARY OF THE INVENTION

The present invention thus provides a point of sale personalization system for a product. The system may include one or more sleeves and an application device for affixing one of the sleeves to the product. The sleeves may include one or more expressions thereon. The application device also may include a barrier to block access temporarily thereto when the application device is activated.

Specific embodiments include that the application device may be a thermal device, such as a shrink-wrap device. The shrink-wrap device may include a product tunnel. The product tunnel may include a turntable. The turntable may rotate at about five (5) to about ten (10) revolutions per minute. The product tunnel also may include a number of ventilation apertures. A heating chamber with a heating element may be positioned adjacent to one of the ventilation apertures. The heating element may operate at about 1,400 to about 3,000 degrees Celsius. An air movement device may recirculate air through the heating element and the product tunnel. The barrier may include a product tunnel door positioned adjacent to the product tunnel.

The application device also may include a computer for use in selecting one of the expressions for use on the sleeves. The sleeves may be made out of a thermoplastic material and may be recyclable.

A method of the present invention provides for personalizing a product at the point of sale. The method may include the steps of providing one or more of the products for sale, providing one or more of the expressions to be applied to the products, and providing an application device for use by the consumer. The consumer may then select one of the expressions to be used with the product, place the expression on the product, and place the product within the application device so as to affix the expression thereon. The product may be a beverage. The expressions may include one or more of the sleeves sized to surround the product. The application device may include a thermal device to affix the expression to the product.

A further method of the present invention provides for personalizing a product at the point of sale by a consumer. The method may include the steps of selecting a product, selecting an expression to be applied to the product, and affixing the expression on the product. The expression may include a shrink-wrap material. The affixing step may include applying heat to the shrink-wrap material. The selecting step may include selecting from a number of the expressions and may include creating the expression with the aid of a computer. The product may be a beverage.

The method may further include the step of purchasing the product prior to the step of selecting an expression to be applied to the product. The method may further include the step of placing the expression on the product prior to the step of affixing the expression on the product.

A further method of the present invention provides for personalizing a product at the point of sale. The method may include the steps of selecting a product, purchasing the product, selecting a shrink-wrap sleeve to be applied to the product, placing the sleeve on the product, and affixing the sleeve on the product. The sleeve may include an expression thereon. The affixing step may include applying heat to the sleeve.

Other objects, features, and advantages of the present invention will become apparent upon review of the following detailed description of the preferred embodiments of the invention, when taken in conjunction with the drawings and the appended claims.

DETAILED DESCRIPTION OF THE INVENTION

Figure 1:
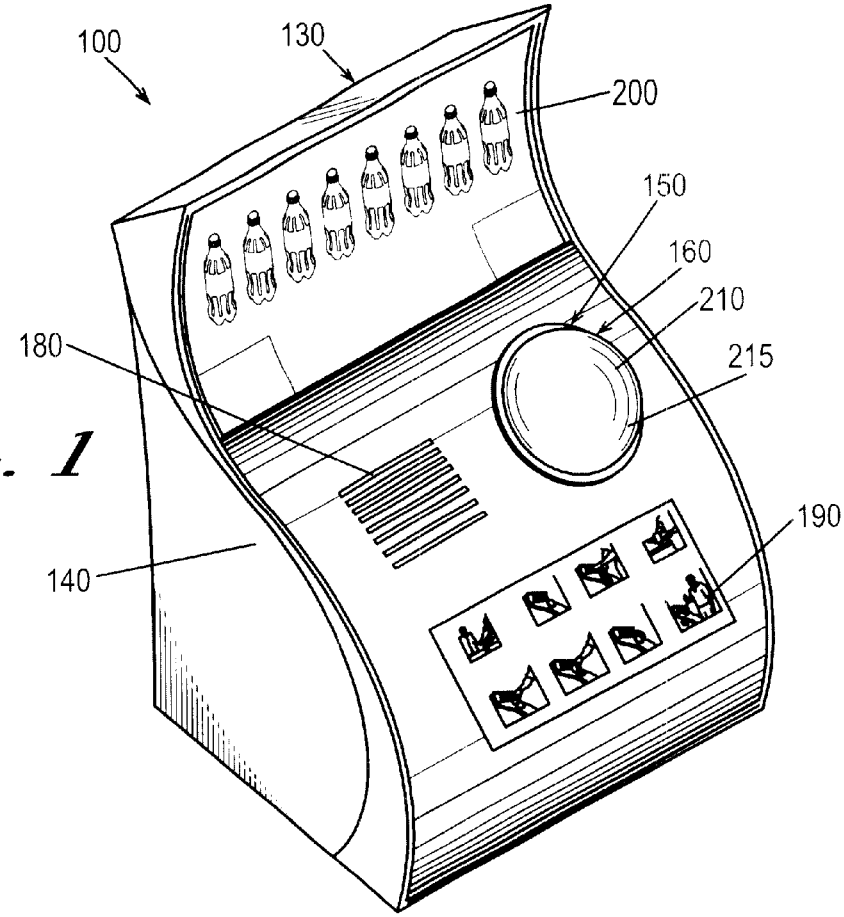
FIG. 1 is a perspective view of the personalization device of the present invention.
Figure 2:
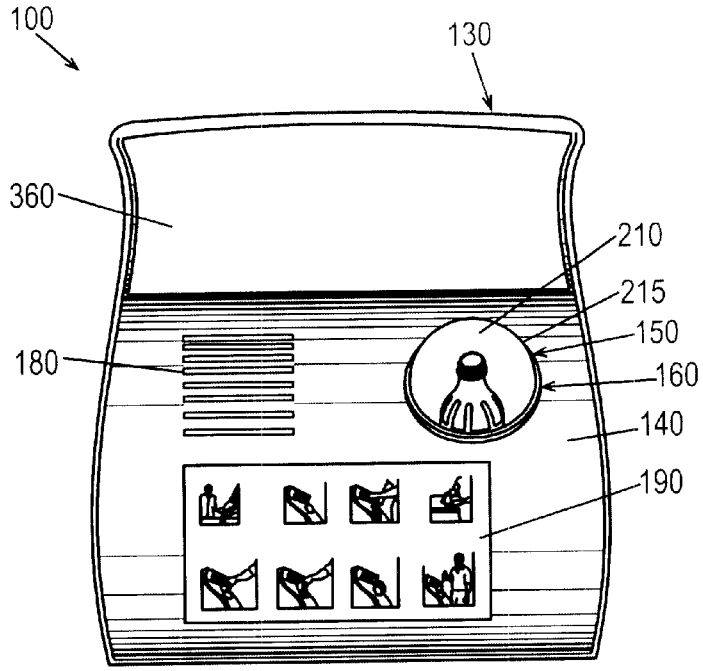
FIG. 2 is a front plan view of an alternative embodiment of the personalization device with a computer therein.
Figure 3:
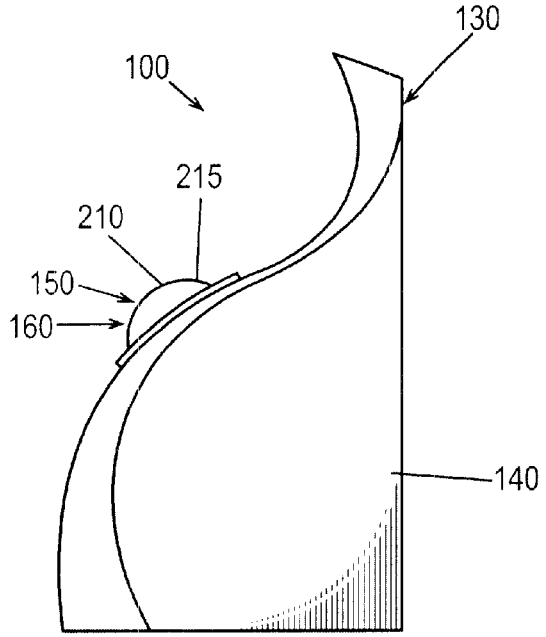
FIG. 3 is a side plan view of the personalization device of FIGS. 1 or 2.
Figure 4:
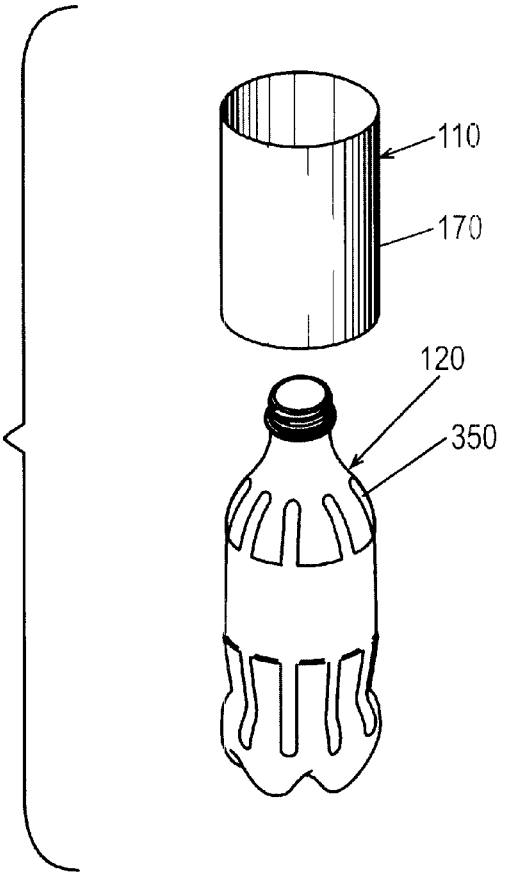
FIG. 4 is a perspective view of a bottle and a sleeve that may be used with the personalization device of FIGS. 1 or 2.
Figure 5:
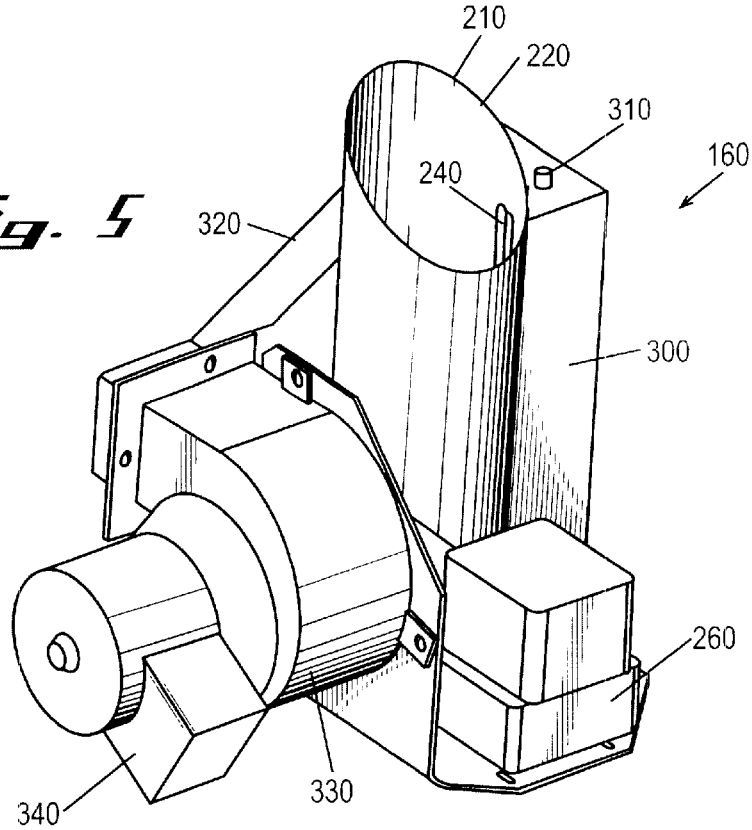
FIG. 5 is a front perspective view of the shrink-wrap device that may be used with the personalization device of FIGS. 1 or 2.
Figure 6:
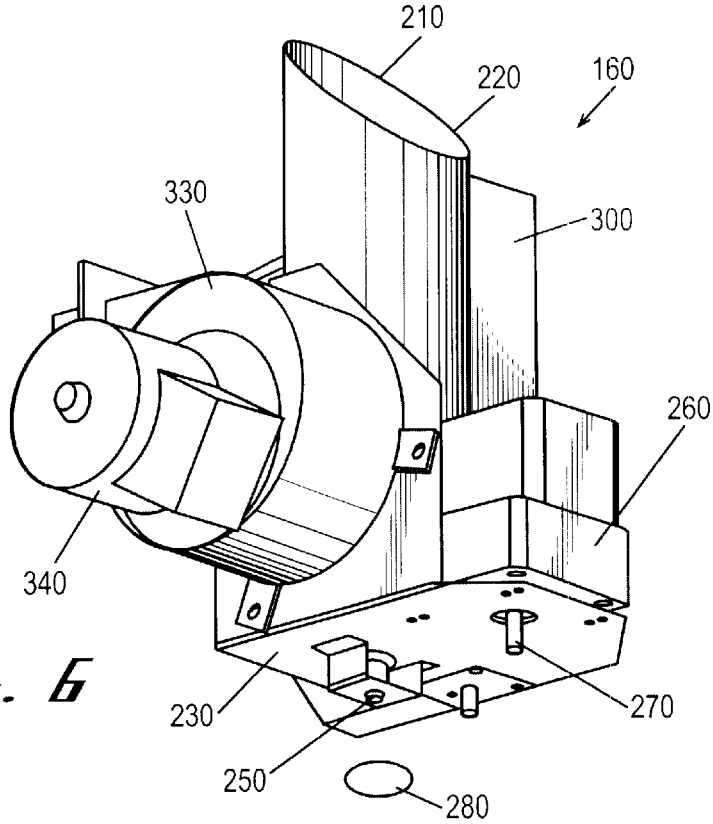
FIG. 6 is a bottom perspective view of the shrink-wrap device of FIG. 5.
Figure 7:
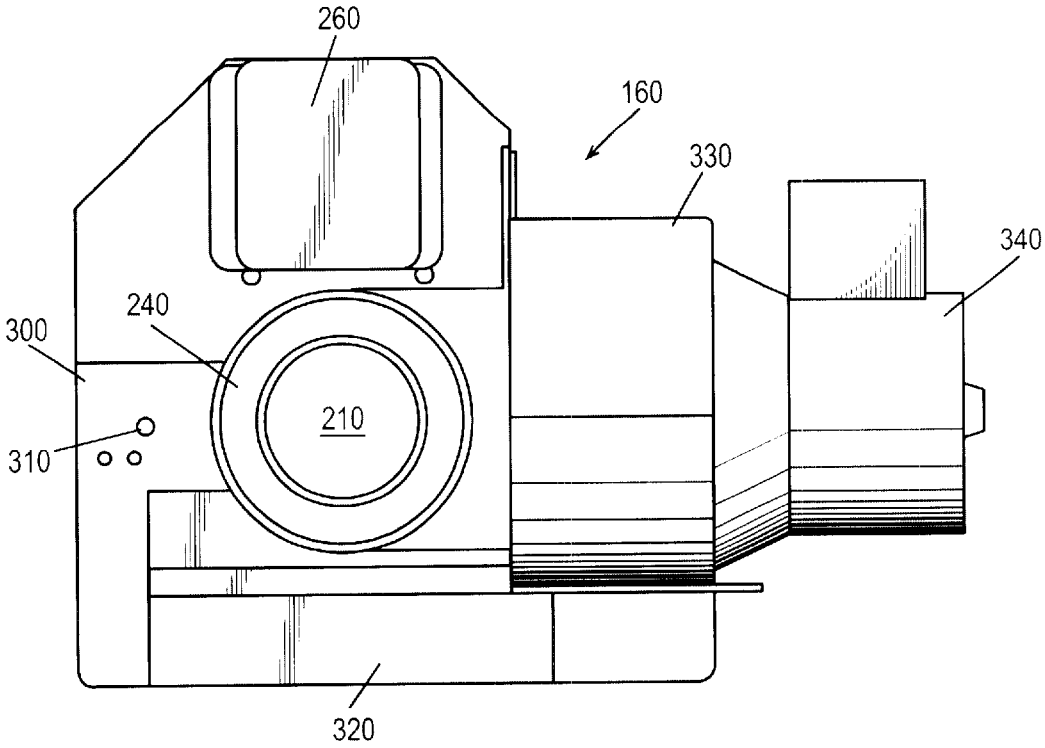
FIG. 7 is a top plan view of the shrink-wrap device of FIG. 5.

Referring now in more detail to the drawings, in which like numerals refer to like elements throughout the several views, FIGS. 1 through 3 show a personalization device 100 of the present invention. The personalization device 100 may apply an expression 110 to a product 120 as is shown in FIG. 4.

In this embodiment, the personalization device 100 may be a counter-top unit 130. The personalization device 100 also may be a stand-alone unit or part of another device such as a refrigerator, vending machine, and the like. The counter-top unit 130 may include an outer frame 140. The outer frame 140 may be of any desired size or shape. The outer frame 140 may be made out of metals, plastics, composite materials, or other types of conventional materials. A conventional electrical outlet, battery, or other type of power source may power the personalization device 100.

The counter-top unit 130 also may include an application device 150. The application device 150 may attach the expression 110 to the product 120. In this embodiment, the application device 150 may be a shrink-wrap device 160 as is described in more detail below. The shrink-wrap device 160 is intended to be used with the expression 110 in the form of a flexible plastic sleeve 170 that may be shrink-wrapped to the product 120. (We use the term "shrink-wrap" in its customary meaning of shrinking a plastic film securely on to an object by the application of heat.) The counter-top unit 130 also may include a number of slots 180 positioned therein. The slots 180 may be in the form of indentations or pockets within the outer frame 140. The slots 180 may be used to house a number of the sleeves 170. Each slot 180 may have a different type or design of the sleeves 170 therein. The counter-top unit 130 also may have instructions 190 for use thereon. The counter-top unit 130 also may have advertising indicia 200 thereon as well. The advertising indicia 200 may promote the product 120, the retail outlet, the use of the personalization device 100, the various expressions 110 therein, any combination thereof, or any other promotion.

The sleeves 170 may be made out of a thermoplastic or a similar material such as a PETG (polyethylene terephthalate, glycol modified) shrink film. Other acceptable materials may include OPS (oriented polystyrene). The sleeve materials preferably are recyclable and food grade. Any convenient material may be used. For example, an aluminum-based material may be used with a microwave-based application device 150. The size and shape of the sleeve 170 may vary with the nature of the product 120. The expression 110 may be printed on to the sleeve 170 via a Roto-Gravure printing method or otherwise applied thereto. The expressions 110 may be printed at a central location and shipped to the individual retail outlets or the expressions may be printed at the individual outlets to reflect local preferences. Alternatively, each personalization device 100 may print the expressions 110 on to the sleeves 170 via a conventional printer and the like.

FIGS. 5 through 8 show the shrink-wrap device 160 of the present invention. The shrink-wrap device 160 may include a product tunnel 210. The product tunnel 210 may have any convenient size or shape with a diameter ranging from about seven and one-half (7.5) to about (10) centimeters and a length of about twenty (20) to about (30) centimeters. The product tunnel 210 is preferably sized to accommodate the intended product 120. The product tunnel 210 may be made out of stainless steel, carbon steel, or similar materials that may withstand the anticipated temperatures therein. The product tunnel 210 may be largely cylindrical in shape with an open product end 220 extending out of or to the outer frame 140 of the counter-top unit 130. Alternatively, the product tunnel 210 may extend down the length of the outer frame 140 and may be accessed along the length of the tunnel 210.

A product door 215 may enclose the product tunnel 210. The product door 215 may be semi-circular in shape as is shown in FIGS. 1 through 3 or may have any convenient shape. Alternatively, the product door 215 may be in the form of a window or a panel if the product tunnel 210 extends down the length of the outer frame 140. The product door 215 may be made out of glass, polycarbonate, or similar types of materials. The product door 215 may be transparent or translucent such that a consumer may view the application process as it proceeds within the product tunnel 210. Operation of the product door 215 may be controlled by a locking device or other type of safety device so as to prevent the product door 215 from opening prior to the completion of the application cycle by the application device 150.

The product tunnel 210 also may have a turntable end 230. A turntable 240 may be positioned within the turntable end 230 of the product tunnel 210 for rotation therein. The turntable 240 may be a disk sized to rotate within the product tunnel 210. The turntable 240 also may be made out of stainless steel, carbon steel, or similar materials. A turntable rod 250 may be attached to the turntable 240 for rotation therewith and may extend in a direction away from the product tunnel 210.

A turntable motor 260 may be positioned adjacent to the product tunnel 210. The turntable motor 260 may be a standard electrical motor with about one and one-half (1.5) to about two and one-half (2.5) watts output power. The turntable motor 260 also may be attached to and drive a motor rod 270. A drive belt 280 (shown disconnected in FIG. 6) may connect the turntable rod 250 and the motor rod 270. The drive belt 280 may be made out of rubber or other types of conventional materials. The turntable motor 260 thus may drive the turntable 240 at about five (5) to ten (10) revolutions per minute.

The product tunnel 210 may have one or more intake ventilation apertures 290 and out-take ventilation apertures 295. The ventilation apertures 290, 295 may be positioned along all or part of the length of the product tunnel 210. Positioned adjacent to one of the intake apertures 290 of the product tunnel 210 may be a heating chamber 300. The heating chamber 300 also may run approximately all or part of the length of the product tunnel 210. The heating chamber 300 may be made out of stainless steel, carbon steel, or similar materials as described above with good thermal resistance. Positioned within the heating chamber 300 may be a heating element 310. The heating element 310 may extend for all or part of the length of the heating chamber 300 and may be positioned adjacent to one of the ventilation apertures 290 of the product tunnel 210. The heating element 310 may a conventional electric element and may include infrared quartz, convection heat emitters, and the like. The heating element 310 may reach about 1,400 to about 3,000 degrees Celsius. The heating element 310 may produce approximately 1,200 to about 1,500 Watts and may operate at about ten (10) to about thirteen (13) amps.

Surrounding the product tunnel 210 and the heating chamber 300 may be an air duct 320. The air duct 320 also may be made out of stainless steel, carbon steel, or similar materials as described above. The air duct 320 may connect the heating chamber 300 with one of the out-take ventilation apertures 295 of the product tunnel 210. The air duct 320 also may have an air inlet 325 open to the atmosphere. The air duct 320 may be otherwise substantially air tight for efficient heating.

Figure 8:
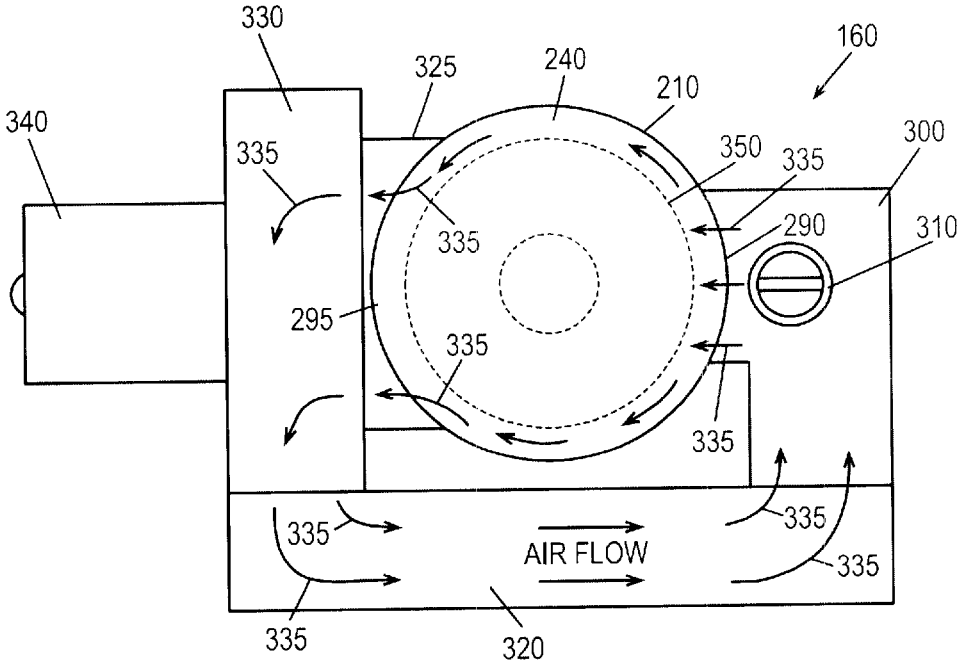
FIG. 8 is a top plan view of the shrink-wrap device of FIG. 5 with the airflow path shown.

Positioned within the air duct 320 may be a blower 330. The blower 330 may be any type of air movement device such as a fan, a pump, a bellows, a screw, and the like known to those skilled in the art. The blower 330 may have a capacity of about 24,000 to about 42,000 cubic centimeters per second. A blower motor 340 may operate the blower 330. The blower motor 340 may be a conventional electrical motor with about five (5) to about ten (10) Watts output power. As is shown in FIG. 8, the blower 330 thus directs a flow of air through the air duct 320, into the heating chamber 300 and past the heating element 310, into the product tunnel 210, back through the air duct 325, and back to the blower 330. The arrows 335 show the direction of the airflow. The air duct 320, the product tunnel 210, and the heating chamber 300 may form continuous recirculation pathway therethrough. Such recirculation of the airflow provides for faster and more efficient heating within the product tunnel 210.

Other types of application devices 150 also may be used in addition to the shrink-wrap device 160. For example, the sleeve 170 may be attached to the product 120 via steam heat, radiant heat, and other types of thermal means. Other options also may include the use of microwave, pressure, acoustics, optics, various combinations thereof, and other means to apply the sleeve 170 to the product 120. Likewise, various types of printers and/or imaging devices also may be used to apply the expression 110 directly to the sleeve 170 or otherwise.

FIGS. 9A through 9H show the possible use of the present invention. In this example, the product 120 may be in the form of a 500 or 600-milliliter bottle 350 containing a carbonated soft drink, a sports drink, water, coffee, teas, fruit drinks, or other types of beverages. The bottle 350 may be a conventional PET bottle and may be recyclable. Although the use of the bottle 350 is shown, the invention is also applicable to other types of containers such as cans, boxes, pouches, or the like. In fact, the invention is generally applicable to any type of product 120, although the use of disposable consumer goods is preferred.

Figure 9A:
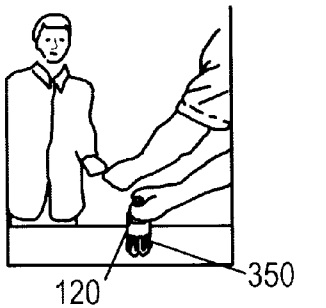
FIGS. 9A through 9H are perspective views showing the operation of the personalization device of FIGS. 1 or 2 by a consumer.

As is shown in FIG. 9A, the consumer selects and/or purchases the product 120, in this case the bottle 350, at any type of retail outlet such as a convenience or a petroleum outlet. Alternatively, the retail outlet may be any location where the product 120 is available for sale or use.

Figure 9B:
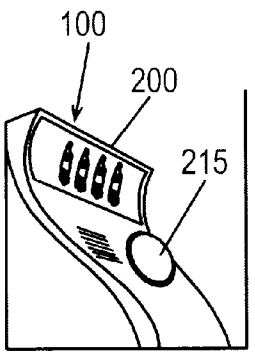

As is shown in FIG. 9B, the consumer may then approach the personalization device 100, which in this embodiment is the counter-top unit 130. Further, the counter-top unit 130 contains the application device 150, in this case the shrink-wrap device 160. As is shown, the counter-top device 130 may have the advertising indicia 200 and the instructions for use 190 thereon.

Figure 9C:
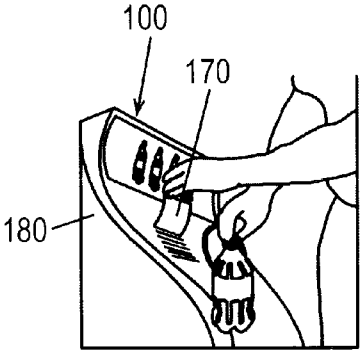
Figure 10A:
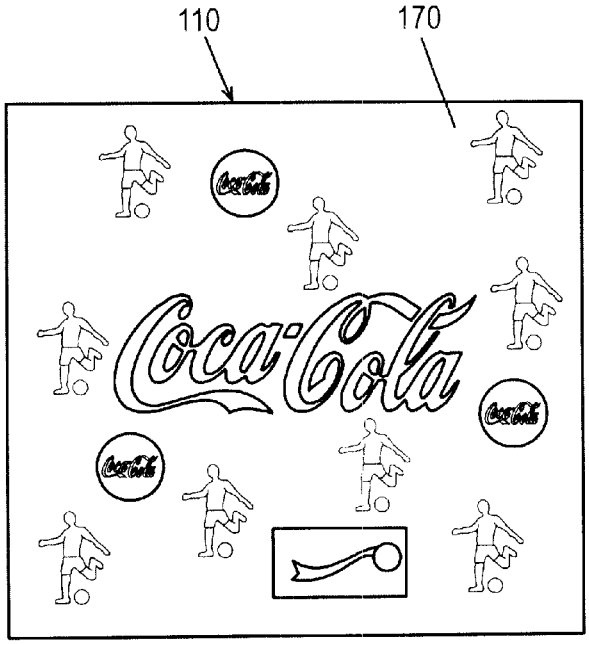
FIG. 10A is a plan view of an expression for use in the personalization device of FIGS. 1 or 2.
Figure 10B:
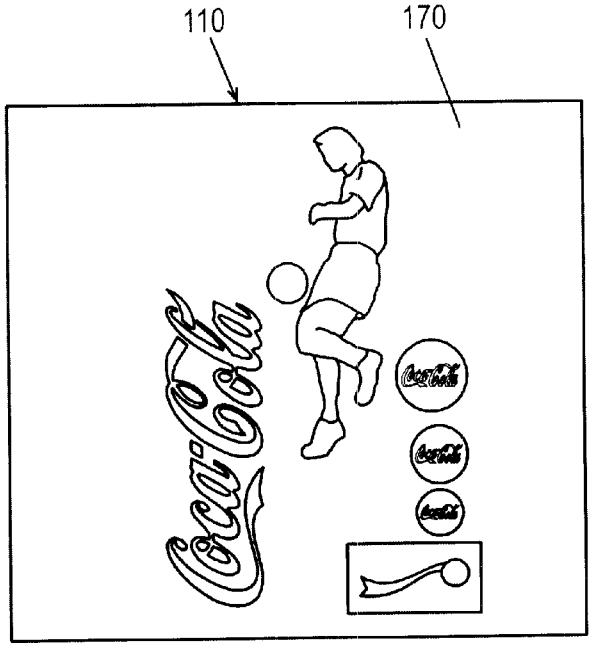
FIG. 10B is a plan view of an expression for use in the personalization device of FIGS. 1 or 2.

As is shown in FIG. 9C, the consumer may then select one of the expressions 110 to place onto the bottle 350. As is shown in FIGS. 10A and 10B, the expressions 110 may convey any type of message desired by the consumer. The expressions 110 shown in FIGS. 10A and 10B express the consumer's interest in football (soccer). The expressions 110, however, can convey any type of message or specifically convey no message at all. For example, the expression 110 may relate to a sporting activity, a team or an event; a dramatic production; a musical group; a cartoon character; a literary character; a location; a season; a product; a company; an individual; and the like. The expression 110 even may include personal photographs. Alternatively, the expression 110 may contain no message whatsoever, but merely display a pleasing color, shape, or design. The different types of expressions 110 are limitless. The expression 110 may or may not permit viewing of the original product packaging, in whole or in part.

As described above, the expressions 110 used in this example are printed on the sleeves 170. For use with a 500-milliliter bottle, the sleeve 170 may be made out of a PETG (Polyethylene terephthalate, glycol modified) shrink film with about 18 centimeters in length and about 0.05 millimeters in thickness. The size and shape of the sleeve 170 may vary with the nature and size of the product 120.

Figure 9D:
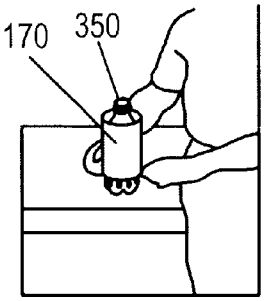

As is shown in FIG. 9D, the consumer may then place the chosen sleeve 170 around the bottle 350. The sleeve 170 may extend for most of the length of the bottle 350 or only a pre-selected amount. More than one sleeve 170 may be used.

Figure 9E:
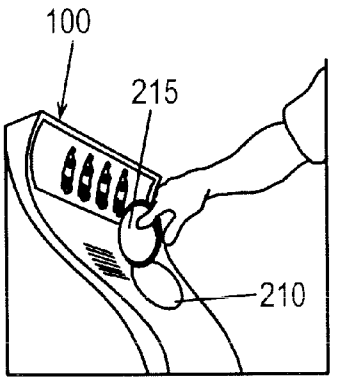
Figure 9F:
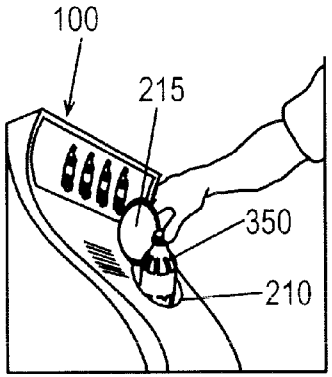
Figure 9G:
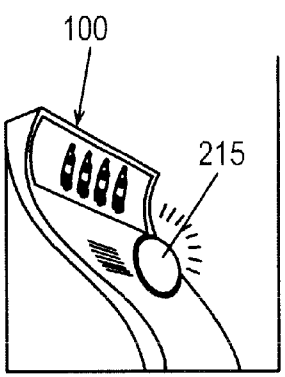

As is shown in FIGS. 9E and 9F, the consumer then opens the product door 215 on the product tunnel 210 and places the bottle 350 within the product tunnel 210 and onto the turntable 240. In the case of the 500-milliliter bottle 350, the product tunnel 210 may have a width of about seven and one-half (7.5) to about ten (10) centimeters and a length of about twenty (20) to about thirty (30) centimeters. The dimensions of the product tunnel 210 may change with the nature and size of the intended product 120.

As is shown in 9G, the personalization device 100 may be activated once the product door 215 is closed. Alternatively, an activation device also may be used. The activation device may be simply a button or a coin operated device. In this embodiment, when the shrink-wrap device 160 is activated, the turntable motor 260 begins to rotate the turntable 240 and the bottle 350. The turntable 240 may rotate at about five (5) revolutions per minute. Although rotation may not be required, the rotation of the product 120 may provide for the even application of the sleeve 170.

The heating element 310 and the blower 330 also are activated. The heated air may have a temperature of approximately 350 degrees Fahrenheit (about 176.6 degrees Celsius). The blower 330 may operate at about 24,000 to about 42,000 cubic centimeters per second. The blower 330 thus circulates air through the air ducts 320, past the heating element 300, and past the rotating bottle 350 so as to shrink-wrap the sleeve 170 onto the bottle 350. The blower 330 continuously circulates the hot air through the product tunnel 210 the heating chamber 300, and the air ducts 320. The application process may last about twenty (20) to twenty-five (25) seconds.

The variables described above with respect to the nature of the sleeve 170, the size of the product tunnel 210, the speed of the turntable 240, the temperature produced by the heating element 310, and the speed of the blower 330 have been determined to shrink wrap the sleeve 170 onto the 500 milliliter bottle 350 in a consistent manner. The sleeve 170 should be applied with a minimum level of distortions thereon. These variables may change depending upon the nature and size of the product 120.

Figure 9H:
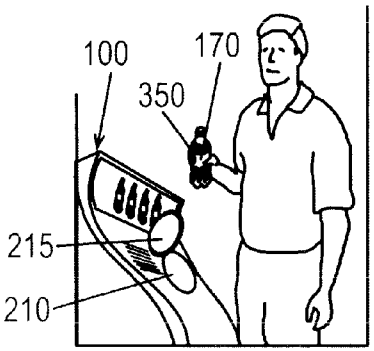

As is shown in FIG. 9H, once the sleeve 170 has been shrink wrapped to the bottle 350 or otherwise applied and the application device 150 has ceased operation, the consumer may open the product door 215 and remove the bottle 350 from the product tunnel 210.

Once removed from the personalization device 100, the consumer may enjoy the beverage within the bottle 350 in the usual manner. The consumer also may carry the bottle 350 or otherwise display the bottle 350 so as to promote the expression 110 if so desired. The expression 110 may be disposed of with the product 120 and may be recycled accordingly. The expression 110 also may be removed from the product 120 if desired.

Although these method steps have been described in terms of being carried out by the consumer, it should be clear that these steps could be carried out for the consumer by or on behalf of the retail outlet or other location. Likewise, these steps could be carried out in part by the consumer and in part by or on behalf of the retail outlet or other location.

The present invention thus allows a consumer to change or to personalize the packaging of the product 120 at the time of purchase. The product 120 thus may reflect some aspect of the consumer's individuality, personality, or preferences. The invention allows the product 120 to be part of the consumer's life in a distinct and innovative way. Specifically, the invention permits the consumer to express him or herself in a unique way. The consumer thus may express his or her own personality through the selection of a different expression 110. The use of the expressions 110 with the brand name of the product 120 also may strengthen the consumer's association between the two. In other words, the expression 110 relating to football may strengthen the consumer's association of the product 120 with football.

In addition to the pre-printed expressions 110, the personalization device 100 also may allow the consumer to design his or her own expression 110. As is shown in FIG. 2, the personalization device 110 may include a conventional computer 360 that may allow the consumer to select or to design further graphics, messages, or any other type of expression 110. In this embodiment, the computer 360 may be positioned where the advertising indicia 200 were located in FIG. 1. For example, the consumer may be able to type in a particular message or select from a list of messages such as "Happy Birthday", "Surf's Up", etc. via a touch screen or otherwise. The personalization device 100 then may print the expression 110 for application as described above. The nature and the extent of the expressions 110 are unlimited. The nature of the expressions 110 may be changed or rotated at a given outlet on a regular basis.

The foregoing description relates only to the preferred embodiments of the present invention. Numerous changes and modification may be made herein without departing from the spirit and scope of the invention as defined by the following claims and the equivalents thereof.

We claim:

1. A point of sale personalization system for a product, comprising:

one or mote sleeves;

said one or more sleeves comprising one or more expressions thereon; and an application device for affixing one of said one or more sleeves to said product;

said application device comprising a shrink-wrap device; and said application device comprising a barrier thereon to block access thereto when said application device is activated.

2. The point of sale personalization system of claim 1, wherein said application device comprises a thermal device.

3. The point of sale personalization system of claim 1, wherein said shrink-wrap device comprises a product tunnel.

4. The point of sale personalization system of claim 3, wherein said product tunnel comprises a turntable positioned therein for rotation therewith.

5. The point of sale personalization system of claim 4, wherein said turntable rotates at about five (5) to about ten (10) revolutions per minute.

6. The point of sale personalization system of claim 3, wherein said product tunnel comprises a plurality of ventilation apertures.

7. The point of sale personalization system of claim 6, wherein said application device comprises a heating chamber positioned adjacent to one of said plurality of ventilation apertures.

8. The point of sale personalization system of claim 6, wherein said application device comprises a heating element positioned adjacent to said product tunnel.

9. The point of sale personalization system of claim 8, wherein said heating element comprises about 1,400 to 3,000 degrees Celsius.

10. The point of sale personalization system of claim 6, wherein said application device comprises an air movement device therein so as to recirculate air through said heating element and said product tunnel.

11. The point of sale personalization system of claim 3, wherein said barrier comprises a product tunnel door positioned adjacent to said product tunnel.

12. The point of sale personalization system of claim 1, wherein said application device comprises a computer for use in selecting one of said one or more expressions for use on said one or more sleeves.

13. The point of sale personalization system of claim 1, wherein said one or more sleeves comprises a thermoplastic material.

14. The point of sale personalization system of claim 1, wherein said one or more sleeves comprises a recyclable material.

15. A method for personalizing a product at the point of sale, comprising the steps of:

providing one or more of said products for sale;

providing one or more expressions to be applied to said one or more products; and providing an application device such that a consumer may:

select one of said one or more expressions to be used with one of said one or more products, place said one expression on said one product, and place said one product within said application device so as to affix said one expression thereon.

16. The method of claim 15, wherein said one or more products comprises a beverage.

17. The method of claim 15, wherein said one or more expressions comprises one or more sleeves sized to envelop said one product.

18. The method of claim 15, wherein said application device comprises a thermal device to affix said one expression to said one product.

19. A method for personalizing a product at the point of sale by a consumer, comprising the steps of:

selecting a product, wherein said product comprises a beverage;

selecting an expression to be applied to said product; and affixing said expression on said product.

20. The method of claim 19, wherein said expression comprises a shrink-wrap material.

21. The method of claim 20, wherein said affixing step comprises applying heat to said shrink-wrap material.

22. The method of claim 19, wherein said selecting an expression step comprising selecting from a plurality of said expressions.

23. The method of claim 19, wherein said selecting an expression step comprises creating said expression with the aid of a computer.

24. The method of claim 19, further comprising the step of purchasing said product prior to said step of selecting an expression to be applied to said product.

25. The method of claim 19, further comprising the step of placing said expression on said product prior to said step of affixing said expression on said product.

26. A method for personalizing a product at the point of sale, comprising the steps of:

selecting a product;

purchasing said product;

selecting a shrink-wrap sleeve to be applied to said product;

placing said sleeve on said product; and affixing said sleeve on said product.

27. The method of claim 26, wherein said sleeve comprises an expression thereon.

28. The method of claim 26, wherein said affixing step comprises applying heat to said sleeve.

* * * * *